US012805682B2

(12) United States Patent
Na et al.

(10) Patent No.: US 12,805,682 B2
(45) Date of Patent: Nov. 24, 2026

(54) CLEANING DEVICE AND OPERATION METHOD THEREOF

(71) Applicant: SAMSUNG ELECTRONICS CO., LTD, Suwon-si (KR)

(72) Inventors: Woojin Na, Suwon-si (KR); Sewoong Choi, Suwon-si (KR); Hyounsoo Kim, Suwon-si (KR); Minro Yun, Suwon-si (KR); Junggyun Han, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 671 days.

(21) Appl. No.: 18/214,198

(22) Filed: Jun. 26, 2023

(65) Prior Publication Data

US 2024/0023771 A1 Jan. 25, 2024

Related U.S. Application Data

(63) Continuation of application No. PCT/KR2023/007857, filed on Jun. 8, 2023.

(30) Foreign Application Priority Data

Jul. 21, 2022 (KR) ..... 10-2022-0090618

(51) Int. Cl.
*A47L 9/28* (2006.01)
*A47L 9/04* (2006.01)

(52) U.S. Cl.
CPC ..... *A47L 9/2847* (2013.01); *A47L 9/0455* (2013.01); *A47L 9/0477* (2013.01); *A47L 9/2831* (2013.01); *A47L 2201/00* (2013.01)

(58) Field of Classification Search
CPC .... A47L 9/0455; A47L 9/0477; A47L 9/0488; A47L 11/4041; A47L 9/2831; A47L 9/2847; A47L 9/2805
(Continued)

(56) References Cited

U.S. PATENT DOCUMENTS 8,745,818 B2 * 6/2014 Iles ..... A47L 9/04 15/384
10,226,157 B2 3/2019 Xu et al.
(Continued)

FOREIGN PATENT DOCUMENTS

EP 4241642 A1 * 9/2023 ..... A47L 9/2831
JP 2000-102499 4/2000
(Continued)

*Primary Examiner* — Bryan R Muller
(74) *Attorney, Agent, or Firm* — STAAS & HALSEY LLP

(57) ABSTRACT

A cleaning device including a main body configured to be movable along a plane; a first roller longitudinally extending in a first direction and rotatable; a first brush on an outer circumferential surface of the first roller; a driver configured to generate power to rotate the first roller; a second roller longitudinally extending in the first direction and spaced apart from the first roller by a first distance and rotatable; and a second brush on an outer circumferential surface of the second roller, wherein the first roller and the second roller are configured so that the first roller is rotatable in a first rotation direction around a longitudinal axis of the first roller, the second roller is rotatable in the first rotation direction around a longitudinal axis of the second roller, the first and the second brush overlap within a first range, and the first distance exceeds the first range.

11 Claims, 16 Drawing Sheets

(58) Field of Classification Search
USPC ..... 15/384
See application file for complete search history.

(56) References Cited

U.S. PATENT DOCUMENTS

| | | | | |
|---|---|---|---|---|
| 2006/0195991 | A1* | 9/2006 | Baumhakel | A47L 11/4077 15/384 |
| 2023/0320548 | A1 | 10/2023 | Sun et al. | |

FOREIGN PATENT DOCUMENTS

| | | | | | |
|---|---|---|---|---|---|
| JP | 2002-165731 | | | 6/2002 | |
| JP | 2003-125991 | A | | 5/2003 | |
| JP | 2006312066 | A | * | 11/2006 | A47L 9/04 |
| JP | 2007-29297 | | | 2/2007 | |
| JP | 2008-104840 | | | 5/2008 | |
| JP | 2008-220519 | | | 9/2008 | |
| JP | 2014-212846 | | | 11/2014 | |
| JP | 2017140203 | A | * | 8/2017 | A47L 9/04 |
| JP | 2020-114540 | A | | 7/2020 | |
| KR | 10-2015-0048490 | | | 5/2015 | |
| KR | 10-2369190 | | | 3/2022 | |
| KR | 10-2369190 | B1 | | 3/2022 | |
| KR | 10-2404988 | B1 | | 6/2022 | |

* cited by examiner

CLEANING DEVICE AND OPERATION METHOD THEREOF

CROSS-REFERENCE TO RELATED APPLICATION

This application is a continuation application, under 35 U.S.C. § 111 (a), of international application No. PCT/KR2023/007857, filed on Jun. 8, 2023, which claims priority under 35 U. S. C. § 119 to Korean Patent Application No. 10-2022-0090618, filed on Jul. 21, 2022, in the Korean Intellectual Property Office, the disclosures of which are incorporated by reference herein in their entireties.

TECHNICAL FIELD

The disclosure relates to a cleaning device for automatically performing a cleaning task and an operation method of the cleaning device, and more particularly, to a cleaning device including a brush that is rotatable around an axis and an operation method of the cleaning device.

BACKGROUND ART

Recent cleaning devices may independently perform cleaning tasks according to a preset method without manual manipulation by a user. For example, an operation time, an operation mode, etc., of a cleaning device may be preset.

The cleaning device may provide various conveniences such as eliminating the need for the user to perform cleaning directly or allowing the user to arbitrarily set an operation mode, an operation time, etc. Due to these conveniences, in recent years, the demand for automatic cleaning devices has increased.

An automatic cleaning device travels indoors according to a preset method, and sucks in dust, small debris, or the like present on the floor. For this purpose, the automatic cleaning device includes a motor for generating a suction force, a dust bin for storing the sucked in dust or small debris, and a filter for purifying air sucked in together into the dust bin and expelling the purified air.

Debris collected by the automatic cleaning device may be in several forms. For example, the debris may include hair separated from the human body, fiber strands detached from clothes, etc.

As the number of members constituting a family household, such as a single-person household, is decreasing, the number of households raising pets is increasing. In this case, the pets have more fur and shed their fur more easily than humans shed hair. Debris such as hair, fiber strands, or pet hair has the property of easily adhering to an object with a rough surface due to electrostatic attraction. At the same time, such debris has the property of not easily being separated from the surface of the object to which it adheres.

Therefore, in daily life, when the debris adheres to a surface of a textile object such as a carpet or rug, it is difficult to separate the debris from the surface. Furthermore, even when an automatic cleaning device collects debris while traveling on a surface such as a carpet or rug, it is difficult separate the debris from the automatic cleaning device.

As a result, user convenience is not only degraded, but there is also a risk that the automatic cleaning device may malfunction or be damaged due to the debris adhering to the automatic cleaning device.

DESCRIPTION OF EMBODIMENTS

Technical Problem

According to an aspect of the disclosure, there is provided a cleaning device and an operation method of the cleaning device that facilitates the collection of debris in the form of hair or fibers scattered around a room or the like.

According to an aspect of the disclosure, there is provided a cleaning device including a suction unit capable of sucking in contaminants of a certain size or larger, and an operation method of the cleaning device.

Furthermore, according to an aspect of the disclosure, there is provided a cleaning device and operation method of the cleaning device capable of easily collecting contaminants by controlling a rotation speed of a brush according to a state of contamination of a surface to be cleaned or a speed at which the cleaning device moves.

In addition, according to an aspect of the disclosure, there is provided a cleaning device with a structure that is simplified by having a detachable brush arranged according to a purpose of use, and an operation method of the cleaning device.

Solution to Problem

According to an embodiment of the disclosure, a cleaning device includes a main body configured to be movable along a plane, a first roller longitudinally extending in a first direction and arranged to be rotatable relative to the main body, a first brush arranged on an outer circumferential surface of the first roller, a driver configured to generate power to rotate the first roller, a second roller longitudinally extending in the first direction and arranged so as to be spaced apart from the first roller by a first distance and to be rotatable relative to the main body, and a second brush arranged on an outer circumferential surface of the second roller, wherein the first roller and the second roller are configured so that the first roller is rotatable in a first rotation direction around a longitudinal axis of the first roller, the second roller is rotatable in the first rotation direction around a longitudinal axis of the second roller, the first brush and the second brush overlap within a first range, and the first distance exceeds the first range.

A ratio of the first range to the first distance may be greater than or equal to 0.04 but less than or equal to 0.32.

The outer circumferential surface of the first roller may have a first circular shape, a radius of the first circular shape may be greater than or equal to 6 mm but less than or equal to 18 mm, and a length of the first brush extending in a radial direction of the first roller may be greater than or equal to 2.9 mm but less than or equal to 8.7 mm.

The outer circumferential surface of the second roller may have a second circular shape, a radius of the second circular shape may be greater than or equal to 1.9 mm but less than or equal to 5.7 mm, and a length of the second brush extending in a radial direction of the second roller may be greater than or equal to 2.1 mm but less than or equal to 6.3 mm.

The first range in which the first brush and the second brush overlap may be a range greater than or equal to 0.5 mm but less than or equal to 1.5 mm.

The first roller may be configured to rotate at a first rotation speed, the second roller may be configured to rotate at a second rotation speed, and the driver may be configured to generate power to rotate the first roller so that a ratio of the second rotation speed to the first rotation speed may be greater than or equal to 0.01 but less than or equal to 0.04.

The first roller may be configured to rotate at a speed greater than or equal to 500 revolutions per minute (rpm) but less than or equal to 1500 rpm.

The second roller may be configured to rotate at a speed greater than or equal to 15 rpm but less than or equal to 20 rpm.

The cleaning device may further include a first sensor configured to detect the first rotation speed of the first roller, a second sensor configured to detect the second rotation speed of the second roller, and a controller configured to respectively receive the first rotation speed and the second rotation speed from the first sensor and the second sensor to control an operation of the driver.

The cleaning device may further include a support frame configured to be detachable from the main body, and the second roller may be configured to be rotatable relative to the support frame.

The longitudinal axis of the second roller may be a rod that is configured to be detachable from the support frame.

The cleaning device may further include bearings at either end of the longitudinal axis of the second roller to support the longitudinal axis of the second roller.

The cleaning device may further include a coupling member that is detachably fastened to the support frame so that the second roller is fixed to the support frame.

An operation method of the cleaning device includes moving the main body along the plane, rotating the first roller at a first rotation speed, and rotating the second roller at a second rotation speed.

A ratio of the first range to the first distance may be greater than or equal to 0.04 but less than or equal to 0.32.

The outer circumferential surface of the first roller may have a first circular shape, a radius of the first circular shape may be greater than or equal to 6 mm but less than or equal to 18 mm, a length of the first brush extending in a radial direction of the first roller may be greater than or equal to 2.9 mm but less than or equal to 8.7 mm, the outer circumferential surface of the second roller may have a second circular shape, a radius of the second circular shape may be greater than or equal to 1.9 mm but less than or equal to 5.7 mm, and a length of the second brush extending in a radial direction of the second roller may be greater than or equal to 2.1 mm but less than or equal to 6.3 mm.

The first range in which the first brush and the second brush overlap may be a range greater than or equal to 0.5 mm but less than or equal to 1.5 mm.

The operation method may further include generating power to rotate the first roller so that a ratio of the second rotation speed to the first rotation speed may be greater than or equal to 0.01 but less than or equal to 0.04.

The operation method may further include, when a ratio of the second rotation speed to the first rotation speed exceeds 0.04 or is less than 0.01, controlling the driver to adjust the first rotation speed.

The first roller may be configured to rotate at a speed greater than or equal to 500 rpm but less than or equal to 1500 rpm, and the second roller may be configured to rotate at a speed greater than or equal to 15 rpm but less than or equal to 20 rpm.

Advantageous Effects of Disclosure

According to an embodiment of the disclosure, a cleaning device and operation method of the cleaning device capable of improving capability of collecting hair or fiber debris scattered around a room or the like by increasing a suction pressure required to suck in contaminants may be provided.

According to an embodiment of the disclosure, a cleaning device including a suction unit capable of sucking in contaminants of a certain size or larger and an operation method of the cleaning device may be provided.

According to an embodiment of the disclosure, a cleaning device and operation method of the cleaning device capable of improving capability of collecting contaminants by controlling a rotation speed of a brush according to a state of contamination of a surface to be cleaned or a speed at which the cleaning device moves may be provided.

In addition, according to an embodiment of the disclosure, a cleaning device with a structure that is simplified by having a detachable brush according to a purpose of use, and an operation method of the cleaning device may be provided.

MODE OF DISCLOSURE

Figure 1:
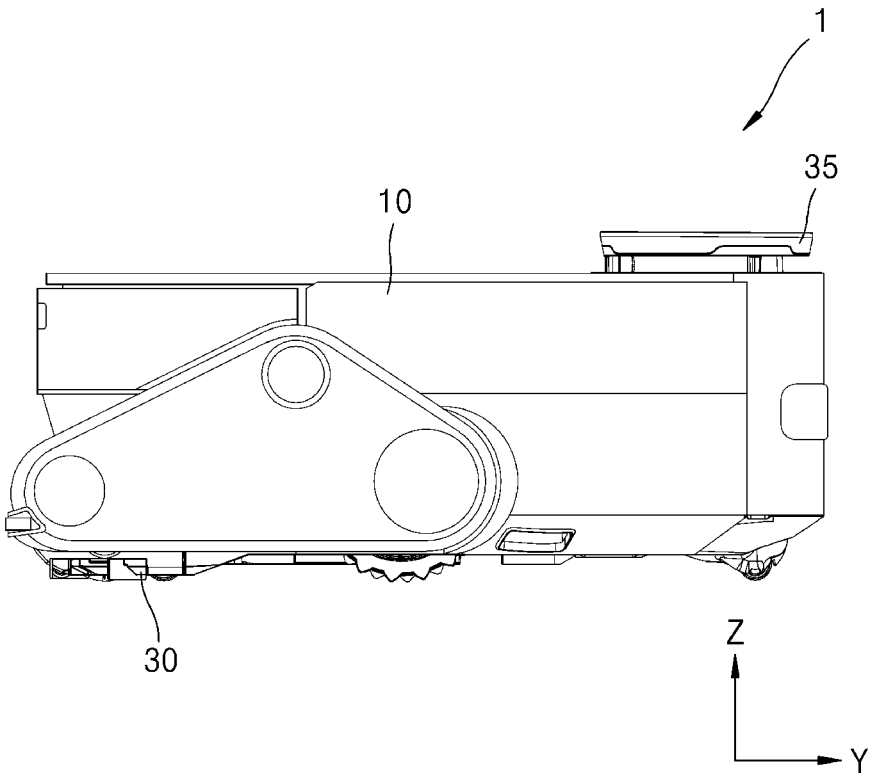
FIG. 1 is a side view of a cleaning device according to an embodiment of the disclosure.

Hereinafter, a configuration and an operation according to the disclosure will be described in detail through an embodiment of the disclosure illustrated in the accompanying drawings.

Terms used in the disclosure will now be briefly described and then an embodiment of the disclosure will be described in detail.

The terms used in the disclosure are general terms currently widely used in the art based on functions described in the disclosure, but may be changed according to an intention of one of ordinary skill in the art, precedent cases, advent of new technologies, etc. Furthermore, some particular terms may be arbitrarily selected by the applicant, and in this case, the meaning of the selected terms will be described in detail in the detailed description of the disclosure. Thus, the terms used herein should be defined not by simple appellations thereof but based on the meaning of the terms together with the overall description of the disclosure.

Throughout the specification, when a part "includes" or "comprises" an element, unless there is a particular description contrary thereto, it is understood that the part may further include other elements, not excluding the other elements.

Furthermore, the terms such as "first", "second", etc., are not intended to limit components but are used to distinguish one component from another component.

An embodiment of the disclosure will now be described more fully hereinafter with reference to the accompanying drawings so that the embodiment be easily implemented by one of ordinary skill in the art. However, the disclosure may be implemented in different forms and should not be construed as being limited to an embodiment of the disclosure set forth herein. In addition, parts not related to descriptions of the disclosure are omitted to clearly explain embodiments of the disclosure in the drawings, and like reference numerals denote like elements throughout.

Moreover, as used in the following description, the terms "top," "bottom," and "front and rear" are defined based on the drawings, and the shape and position of each component are not limited by these terms.

Hereinafter, an embodiment of the disclosure is described in detail with reference to the accompanying drawings.

Figure 2:
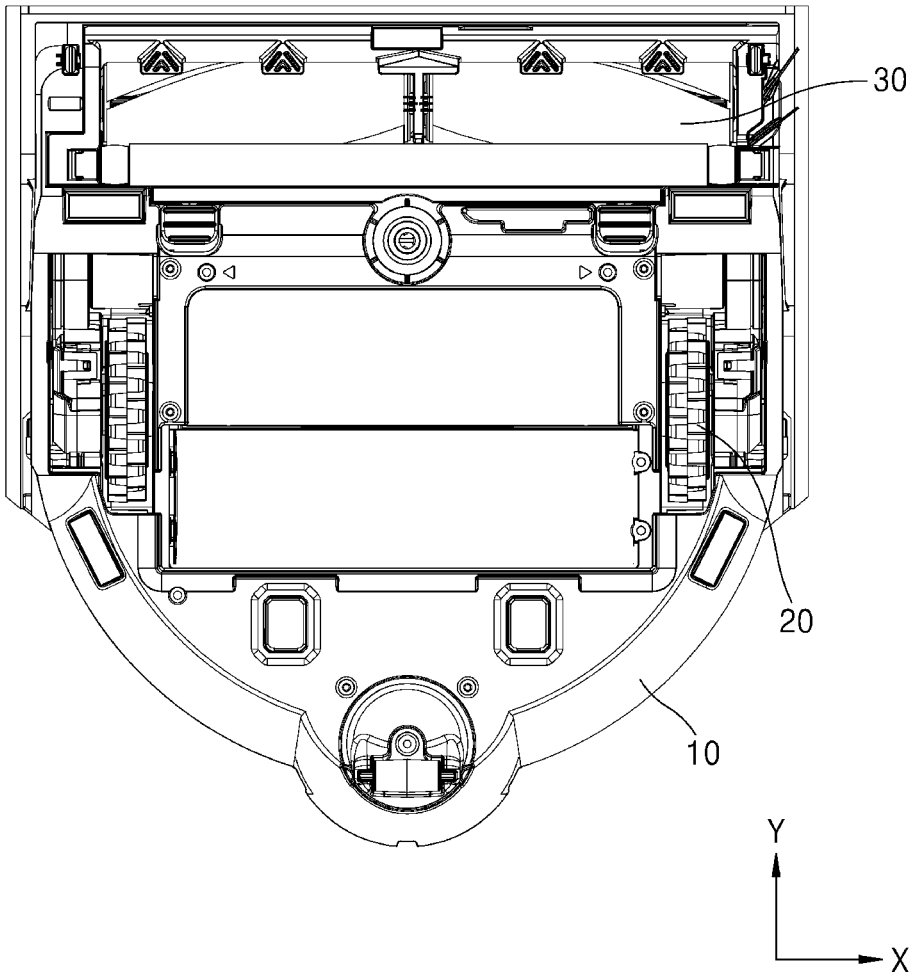
FIG. 2 is a bottom view of a cleaning device according to an embodiment of the disclosure.

FIG. 1 is a side view of a cleaning device according to an embodiment of the disclosure. FIG. 2 is a bottom view of a cleaning device according to an embodiment of the disclosure.

A cleaning device 1 according to an embodiment of the disclosure is mainly described as a robot cleaning device capable of independently performing a cleaning operation according to a preset method without manual manipulation by a user. However, the disclosure is not limited thereto, and the cleaning device 1 according to the disclosure may be applied to any cleaning device operating according to manual manipulation by the user.

Referring to FIGS. 1 and 2, according to an embodiment of the disclosure, the cleaning device 1 may include a main body 10, a traveling unit 20 capable of moving the main body 10 along a plane, a suction unit 30 that sucks in foreign substances present on a surface to be cleaned, and a dust collection container (not shown) in which the foreign substances sucked in from the surface to be cleaned are received.

According to an embodiment of the disclosure, the main body 10 may form an outer shape of the cleaning device 1. For example, the main body 10 may be provided in the shape of a housing including a receiving space therein. In this case, the main body 10 may accommodate components for the cleaning device 1 to perform cleaning operations in the receiving space. For example, the dust collection container to be described later may be removably accommodated in the main body 10. In this case, an inner space of the main body 10 may communicate with the outside. Accordingly, as the cleaning device 1 travels, air or small debris collected via the suction unit 30 may pass through into the inner space of the main body 10 and be collected in the dust collection container removably coupled to the main body 10.

For example, the main body 10 may collide with various obstacles in an area where the cleaning device 1 travels, e.g., an indoor area. Therefore, the main body 10 may include a material with high stiffness to prevent damage due to collision. In addition, the main body 10 may include a lightweight material. Accordingly, power required for the cleaning device 1 to travel may be reduced. For example, the main body 10 may include a synthetic resin such as reinforced plastic or the like.

A user interface may be provided outside the main body 10. The user may control an operation of the cleaning device 1 by manipulating the user interface. Also, the user interface may display information about the cleaning device 1 and a condition of an area over which the cleaning device 1 travels.

In the illustrated embodiment of the disclosure, the main body 10 may have a circular plate shape with a circular cross-section and a certain height in a longitudinal direction. Accordingly, when the cleaning device 1 collides with various obstacles while traveling, the main body 10 may be rotated and moved in various directions.

The traveling unit 20 may move the main body 10 along a plane, e.g., an XY plane. According to an embodiment of the disclosure, the traveling unit 20 may include one or more driving wheels and a traveling motor for generating power transmitted to the driving wheels. For example, the traveling unit 20 may be rotatably coupled to a bottom of the main body 10. For example, the traveling unit 20 may be configured as a plurality of traveling units 20. In this case, a rotation speed and a rotation direction of each of the traveling units 20 may be controlled independently of each other. Accordingly, the main body 10 may be moved forward or rearward or turned left or right on the plane (the XY plane).

According to an embodiment of the disclosure, a travel sensor 35 may be provided to detect information about a path along which the cleaning device 1 travels. For example, the travel sensor 35 may be located in a direction in which the cleaning device 1 is scheduled to travel. For example, the traveling sensor 35 may be provided on the main body 10 to detect information about an environment in front of the cleaning device 1. According to an embodiment of the disclosure, the traveling sensor 35 may be provided in any form capable of detecting information about an environment around a path along which the cleaning device 1 is traveling or is to travel. For example, the traveling sensor 35 may include a light detection and ranging (LiDAR) sensor for detecting a distance to an obstacle, etc., a camera capable of detecting image information, or the like.

The dust collection container (not shown) may store debris collected while the cleaning device 1 travels. For example, contaminants present on the surface to be cleaned may be received in the dust collection container. According to an embodiment of the disclosure, the dust collection container may be detachably coupled to the main body 10. The user may detach the dust collection container from the main body 10 to easily remove contaminants contained in the dust collection container.

According to an embodiment of the disclosure, the dust collection container may include a certain receiving space therein. The receiving space may communicate with a space formed inside the main body 10, e.g., a movement passage. Contaminants collected via the suction unit 30 may pass through the movement passage formed inside the main body 10 into the dust collection container.

The suction unit 30 may suck in contaminants by using a suction motor (not shown) that generates a suction force required to draw in foreign substances on the surface to be cleaned. However, among the contaminants collected through the suction unit 30, some contaminants such as hair, fiber strands, or pet hair have the property of easily adhering to an object with a rough surface due to electrostatic attraction. At the same time, the contaminants have the property of not easily being separated from the surface of the object to which they adhere. Therefore, in daily life, when the contaminants adhere to a surface of a textile object such as a carpet or rug, it is difficult to separate the contaminants from the surface.

According to an embodiment of the disclosure, an output power of the suction motor may be increased to increase a suction pressure applied by the suction unit 30. In addition, when the output power of the suction motor is set to be equal, the suction pressure applied by the suction unit 30 may be increased by reducing an area of suction by the suction unit 30. Hereinafter, technical features that increase a suction pressure applied by the suction unit 30 by reducing an area of suction by the suction unit 30 are described in more detail.

Figure 3:
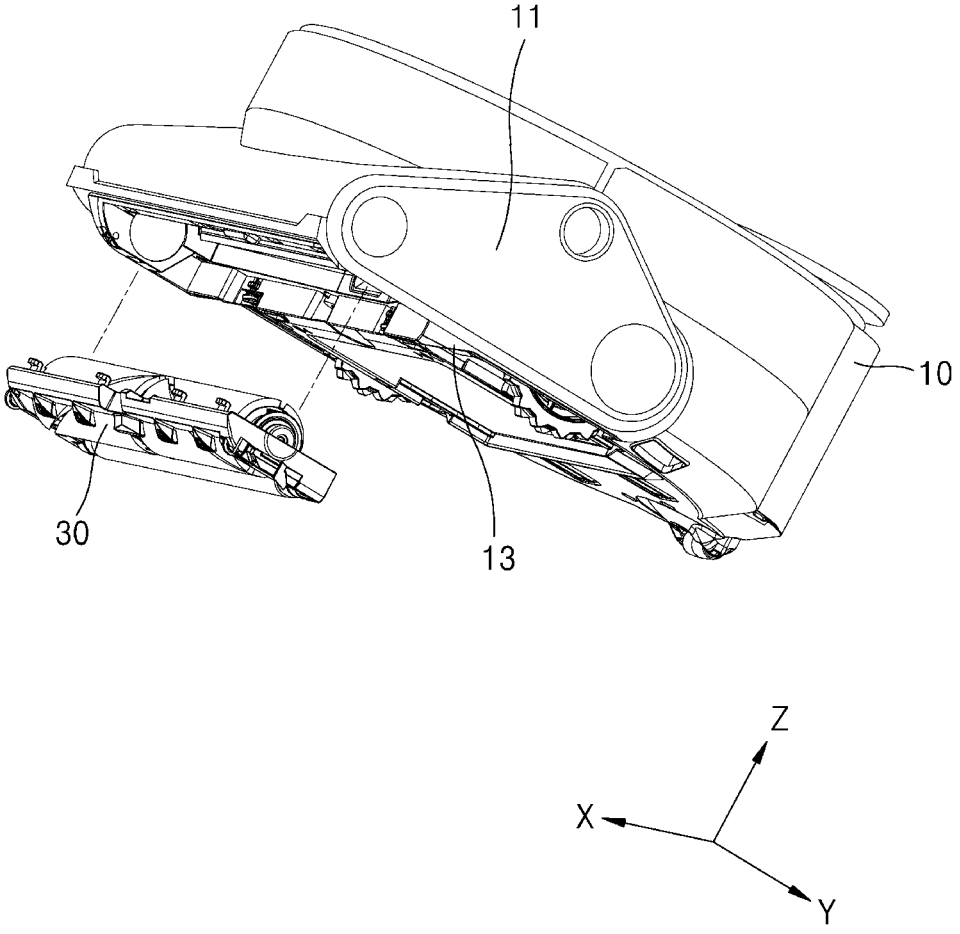
FIG. 3 is an exploded perspective view of a cleaning device according to an embodiment of the disclosure.
Figure 4:
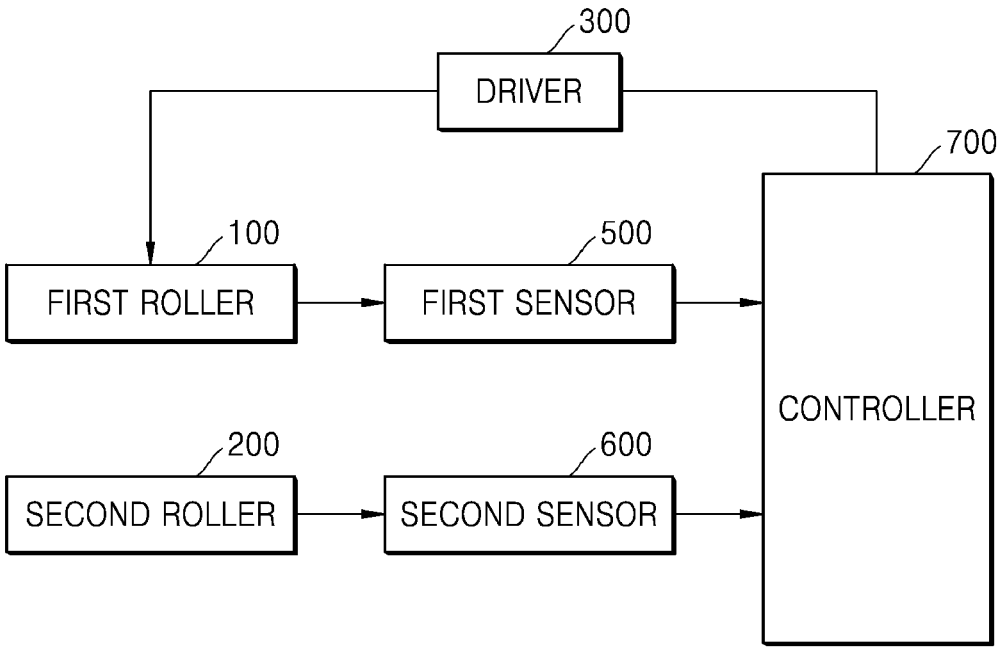
FIG. 4 is a block diagram of a cleaning device according to an embodiment of the disclosure.
Figure 5A:
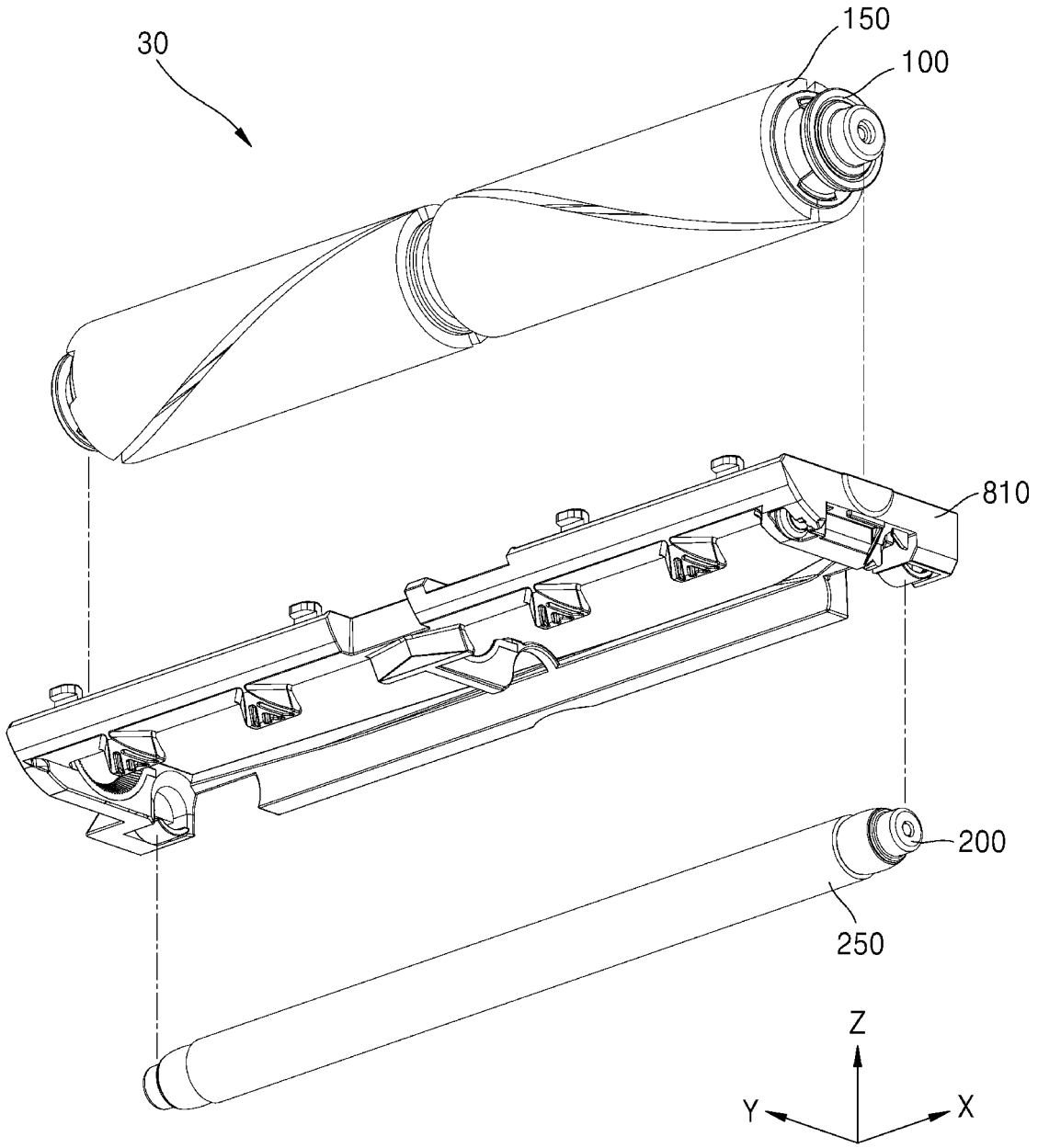
FIG. 5A is an exploded perspective view of a suction unit according to an embodiment of the disclosure.
Figure 5B:
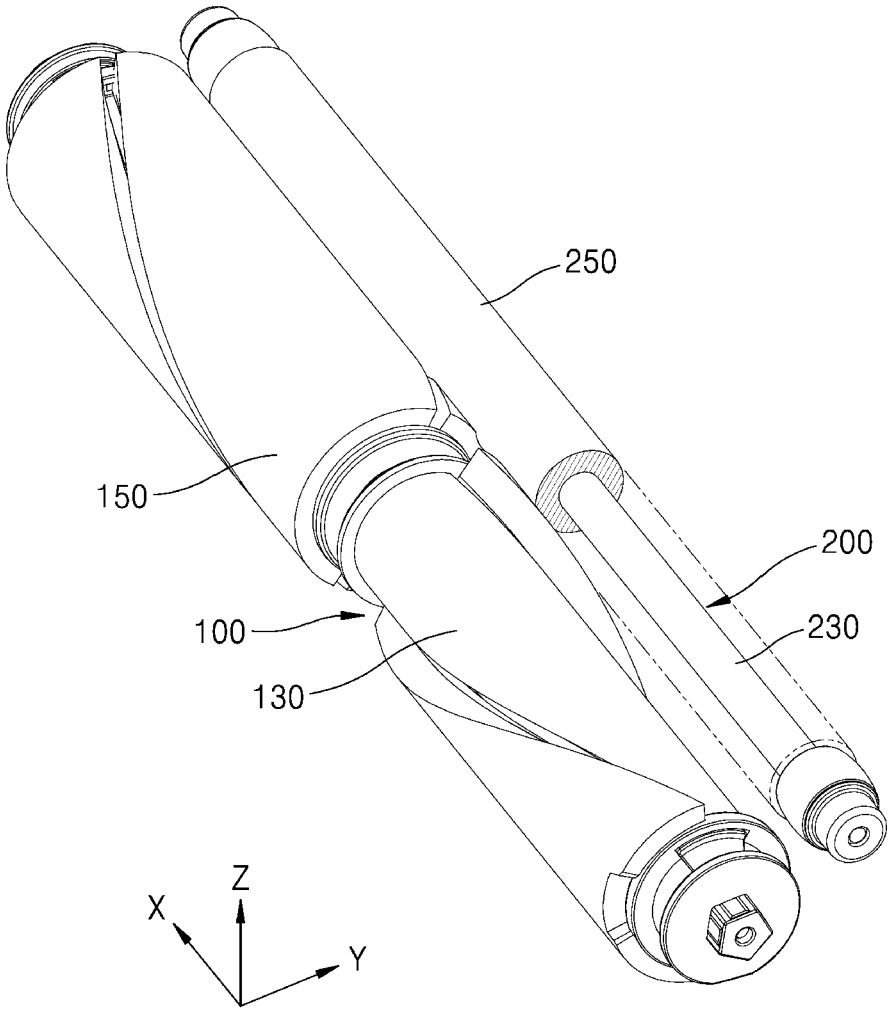
FIG. 5B is a perspective view of a first roller, a first brush, a second roller, and a second brush, according to an embodiment of the disclosure.
Figure 6:
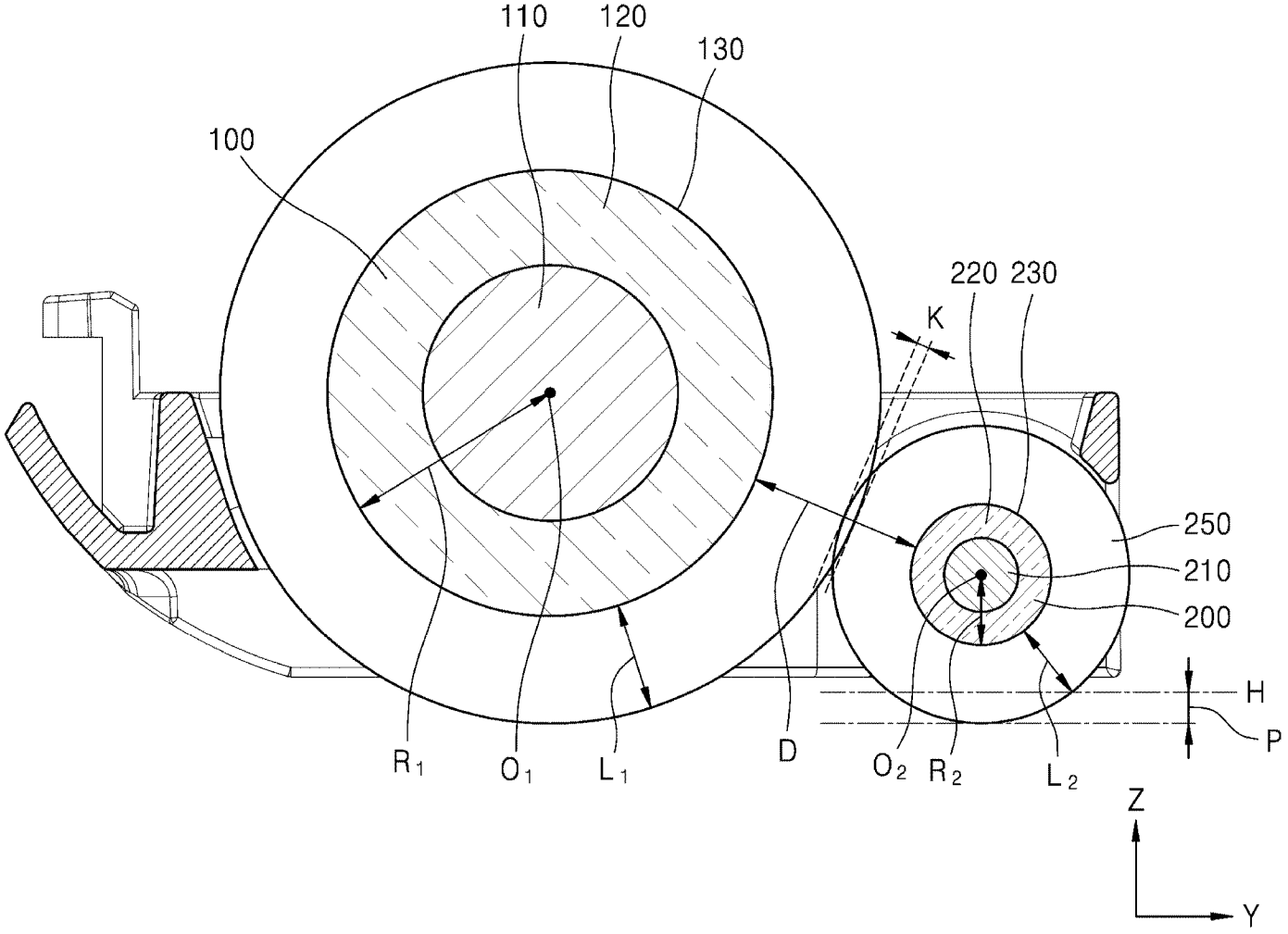
FIG. 6 is a cross-sectional view of a suction unit according to an embodiment of the disclosure.
Figure 7A:
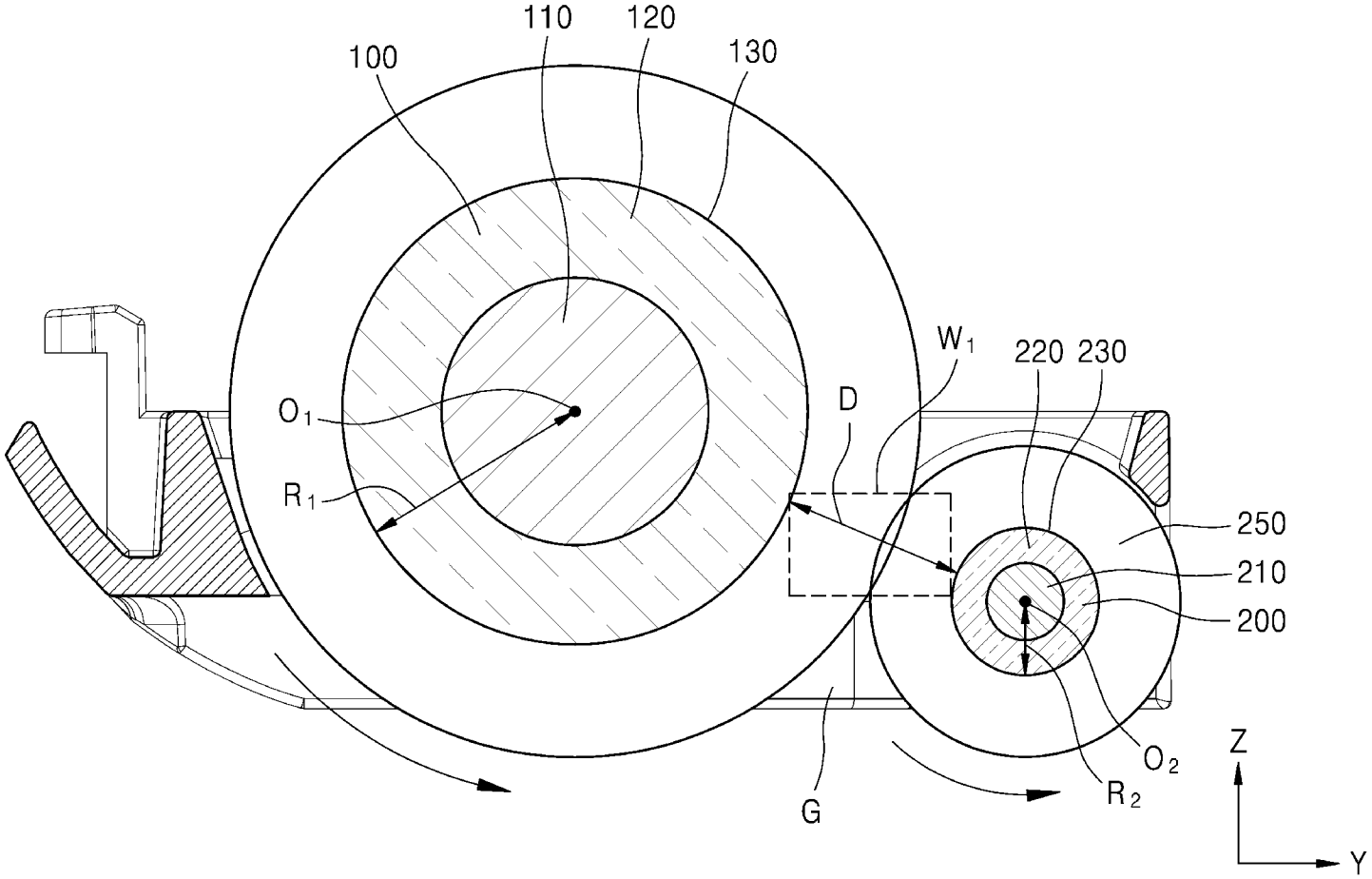
FIG. 7A is a cross-sectional view of a suction unit that sucks in contaminants, according to an embodiment of the disclosure.
Figure 7B:
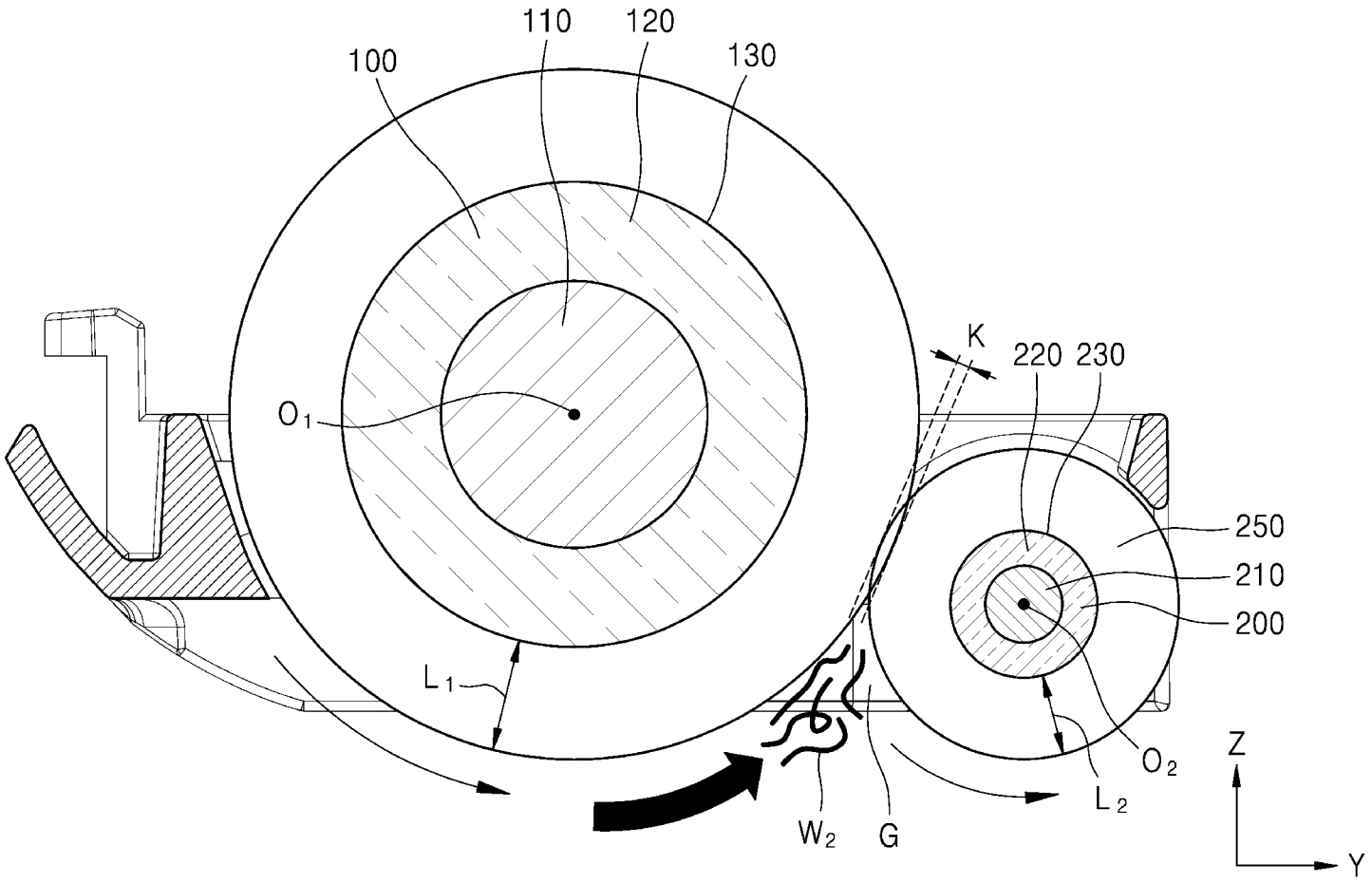
FIG. 7B is a cross-sectional view of a suction unit that sucks in contaminants, according to embodiment of the disclosure.

FIG. 3 is an exploded perspective view of a cleaning device according to an embodiment of the disclosure. FIG. 4 is a block diagram of a cleaning device according to an embodiment of the disclosure. FIG. 5A is an exploded perspective view of a suction unit according to an embodiment of the disclosure. FIG. 5B is a perspective view of a first roller, a first brush, a second roller, and a second brush, according to an embodiment of the disclosure. FIG. 6 is a cross-sectional view of a suction unit according to an embodiment of the disclosure. FIG. 7A is a cross-sectional view of a suction unit for sucking in contaminants, according to an embodiment of the disclosure. FIG. 7B is a cross-sectional view of a suction unit that sucks in contaminants, according to embodiment of the disclosure.

Referring to FIGS. 3 to 6, according to an embodiment of the disclosure, the suction unit 30 may include a first roller 100, a first brush 150, a second roller 200, a second brush 250, and a driver 300, a first sensor 500, a second sensor 600, and a controller 700.

The first roller 100 may be connected to be rotatable relative to the main body 10 around a first axis 110, such a shaft or rod, extending along a first direction (X direction). According to an embodiment of the disclosure, both ends of the first roller 100 may be rotatably supported on side frames 11 provided in the main body 10, so that the first roller 100 is rotatable about the first axis 110 in a first rotation direction, e.g., in either clockwise or counter-clockwise direction. For example, a rotation speed at which the first roller 100 rotates around the first axis 110 in the first rotation direction may be greater than or equal to 500 revolutions per minute (rpm) but less than or equal to 1500 rpm.

According to an embodiment of the disclosure, the driver 300 may generate power and transmit the power to the first roller 100 such that the first roller 100 may rotate around the first axis 110 in the first rotation direction. At this time, the controller 700 may control the driver 300 to control the rotation speed and rotation direction of the first roller 100. For example, the first sensor 500 may be provided at one or more of the ends of the first roller 100 in a direction in which the first roller 100 extends. The first sensor 500 may detect information related to rotation, such as a rotation direction, a rotation angle, etc., of the first roller 100.

In addition, according to an embodiment of the disclosure, the first roller 100 may be formed to extend in one direction, e.g., the first direction (X direction). For example, the first direction (X direction) may be perpendicular to a direction in which the cleaning device 1 moves forward, e.g., a second direction (Y direction). Therefore, when the cleaning device 1 moves forward, an area of a region swept by the first brush 150 provided on an outer circumferential surface of the first roller 100, as described later, may be increased. Accordingly, the cleaning efficiency of the cleaning device 1 may be improved.

Furthermore, according to an embodiment of the disclosure, the first roller 100 may have any shape capable of rotating around an axis between the side frames 11. For example, a cross-section of the first roller 100 taken in the second direction (Y direction) perpendicular to the first direction (X direction) may have a first circular shape 120. In this case, a radius $R_1$ of the first circular shape 120 measured from a center $O_1$ of the first roller 100 may be greater than or equal to 6 mm but less than or equal to 18 mm. In the embodiment of the disclosure, it has been described that the first roller 100 has a circular cross-section, but the disclosure is not limited thereto. According to an embodiment of the disclosure, the cross-section of the first roller 100 may have a polygonal shape.

According to an embodiment of the disclosure, the first roller 100 may include a material with high stiffness capable of supporting the first brush 150 as described later. For example, the first roller 100 may include a synthetic resin such as reinforced plastic. For example, the outer circumferential surface 130 of the first roller 100 is a support member on which one end of the first brush 150 is supportable. In addition, the outer circumferential surface 130 of the first roller 100 may set a boundary range through which contaminants having a certain size are allowed to pass.

The first brush 150 may be provided on the outer circumferential surface 130 of the first roller 100. According to an embodiment of the disclosure, the first brush 150 may be a structure of a plurality of brushes extending in a radial direction of the first roller 100. For example, a length $L_1$ of the first brush 150 extending in the radial direction of the first roller 100 may be greater than or equal to 2.9 mm but less than or equal to 8.7 mm.

According to an embodiment of the disclosure, the one end of the first brush 150 may be fixed to the outer circumferential surface 130 of the first roller 100. Also, the other end of the first brush 150 may be provided to face the surface to be cleaned. For example, the first brush 150 may include an elastic material having a certain elastic property. In this case, the length $L_1$ of the first brush 150 may be determined so that the other end of the first brush 150 may be partially exposed to an outside of a lower frame 13 of the main body 10. Accordingly, the other end of the first brush 150 may be provided to contact the surface to be cleaned. When the other end of the first brush 150 contacts the surface to be cleaned, the first brush 150 may be deformed to correspond to a shape of the surface to be cleaned. In this case, contaminants such as hairs or the like on the surface to be cleaned may adhere to the deformed first brush 150 and be moved to a suction port G.

As described above, a suction pressure may be generated by the suction motor to suck in the contaminants moved to the suction port G into the movement passage provided inside the main body 10. In this case, when an area of the suction port G increases, a suction pressure, e.g., a suction speed, at the suction port G may decrease. Furthermore, when the area of the suction port G is reduced to increase the suction pressure at the suction port G, contaminants of a size exceeding a size of the reduced suction port G are blocked by the suction port G and may not be sucked into the movement passage provided in the main body 10. Thus, while the area of the suction port (G) where the suction pressure is generated may be substantially reduced, a suction port G is required through which contaminants of a size exceeding the size of the reduced suction port G are allowed to pass.

The second roller 200 may be spaced apart from the first roller 100 by a first distance D therebetween to thereby set a boundary area of the suction port G through which contaminants are allowed to pass. According to an embodiment of the disclosure, the second roller 200 may be connected to be rotatable relative to the main body 10 around a second axis 210, such as a shaft or rod, extending in the first direction (X direction). According to an embodiment of the disclosure, both ends of the second roller 200 may be supported on the side frames 11 provided in the main body 10, so that the second roller 200 is rotatable around the second axis 210 in the first rotation direction that is the same as the rotation direction of the first roller 100. For example, a rotation speed at which the second roller 200 rotates around the second axis 210 in the first rotation direction may be greater than or equal to 15 rpm but less than or equal to 20 rpm.

For example, the second sensor 600 may be provided at one or more of the ends of the second roller 200 in a direction in which the second roller 200 extends. The second sensor 600 may detect information related to rotation, such as a rotation direction, a rotation angle, etc., of the second roller 200.

According to an embodiment of the disclosure, the second roller 200 may have any shape capable of rotating about an axis between the side frames 11. For example, a cross-section of the second roller 200 taken in the second direction (Y direction) perpendicular to the first direction (X direction) may have a second circular shape 220. In this case, a radius $R_2$ of the second circular shape 220 measured from a center $O_2$ of the second roller 200 may be greater than or equal to 1.9 mm but less than or equal to 5.7 mm. In the embodiment of the disclosure, it has been described that the second roller 200 has a circular cross-section, but the disclosure is not limited thereto. According to an embodiment of the disclosure, the cross-section of the second roller 200 may have a polygonal shape.

According to an embodiment of the disclosure, the second roller 200 may include a material with high stiffness capable of supporting the second brush 250 as described later. For example, the second roller 200 may include a synthetic resin such as reinforced plastic. For example, an outer circumferential surface 230 of the second roller 200 is a support member on which one end of the second brush 250 is supportable.

As described above, the second roller 200 may be spaced apart from the first roller 100 by the first distance D therebetween to thereby set a boundary area of the suction port G through which contaminants are allowed to pass. For example, the outer circumferential surface 130 of the first roller 100 and the outer circumferential surface 230 of the second roller 200 may both set a boundary range through which contaminants having a certain size are allowed to pass. In this case, the first distance D by which the first roller 100 and the second roller 200 are spaced apart from each other may be set to a distance obtained by subtracting the radius $R_1$ of the first circular shape 120 and the radius $R_2$ of the second circular shape 220 from a distance between the center $O_1$ of the first roller 100 and the center $O_2$ of the second roller 200. That is, the first distance D by which the first roller 100 and the second roller 200 are spaced apart from each other may be a distance between the outer circumferential surface 130 of the first roller 100 and the outer circumferential surface 230 of the second roller 200. Therefore, as shown in FIG. 7A, a contaminant W1 having a length less than the first distance D by which the first roller 100 and the second roller 200 are spaced apart from each other may pass through the suction port G into the main body 10.

The second brush 250 may be provided on the outer circumferential surface 230 of the second roller 200. According to an embodiment of the disclosure, the second brush 250 may be a structure of a plurality of brushes extending in a radial direction of the second roller 200. For example, a length $L_2$ of the second brush 250 extending in the second direction (Y direction) may be greater than or equal to 2.1 mm but less than or equal to 6.3 mm.

According to an embodiment of the disclosure, the one end of the second brush 250 may be fixed to the outer circumferential surface 230 of the second roller 200. Also, the other end of the second brush 250 may be provided to face the surface to be cleaned. For example, the second brush 250 may include an elastic material having a certain elastic property. In this case, the length $L_2$ of the second brush 250 may be determined so that the other end of the second brush 250 may be partially exposed to the outside of the lower frame 13 of the main body 10. Accordingly, the other end of the second brush 250 may be provided to contact a surface H to be cleaned in a certain range P. For example, the certain range P where the other end of the second brush 250 contacts the surface H to be cleaned may be a range greater than or equal to 0.25 mm but less than or equal to 0.75 mm. When the other end of the second brush 250 contacts the surface H to be cleaned, the second brush 250 is able to rotate in the same first rotation direction as the first brush 150 due to a frictional force against the surface H to be cleaned. However, the disclosure is not limited thereto, and the other end of the second brush 250 and the surface H to be cleaned may be spaced apart from each other.

According to an embodiment of the disclosure, the second brush 250 is not intended to adhere contaminants thereto, but is provided to overlap with the first brush 150 to reduce the area of the suction port G. Therefore, a separate driver for forcibly rotating the second roller 200 and the second brush 250 is not required. Accordingly, convenience for design may be improved, and manufacturing costs may be reduced. However, the disclosure is not limited thereto, and a separate driver for driving the second roller 200 may be provided.

As described above, the second brush 250 may be provided to overlap with the first brush 150 to reduce the area of the suction port G. According to an embodiment of the disclosure, the first brush 150 and the second brush 250 may be provided to overlap within a first range K. For example, the first range K in which the first brush 150 and the second brush 250 overlap may be a range greater than or equal to 0.5 mm but less than or equal to 1.5 mm. As the first brush 150 and the second brush 250 overlap within the first range K, a suction pressure at the suction port G may increase. Therefore, as shown in FIG. 7B, contaminants such as pet hairs having a strong adhesive force may be sucked into the suction port G.

In other words, the first distance D by which the first roller 100 and the second roller 200 are spaced apart from each other may exceed the first range K where the first brush 150 and the second brush 250 overlap with each other. According to an embodiment of the disclosure, a ratio of the first range K to the first distance D may be greater than or equal to 0.04 but less than or equal to 0.32. Accordingly, the suction pressure may be increased by substantially reducing the area of the suction port G where the suction pressure is generated within the first range K where the first brush 150 and the second brush 250 overlap. In addition, because contaminants exceeding the size of the reduced suction port G are allowed to pass through the suction port G by deforming the first brush 150 and the second brush 250 having an elastic property, the area of the suction port G may be maintained within a range of the first distance D by which the first roller 100 and the second roller 200 are spaced apart.

Figure 8A:
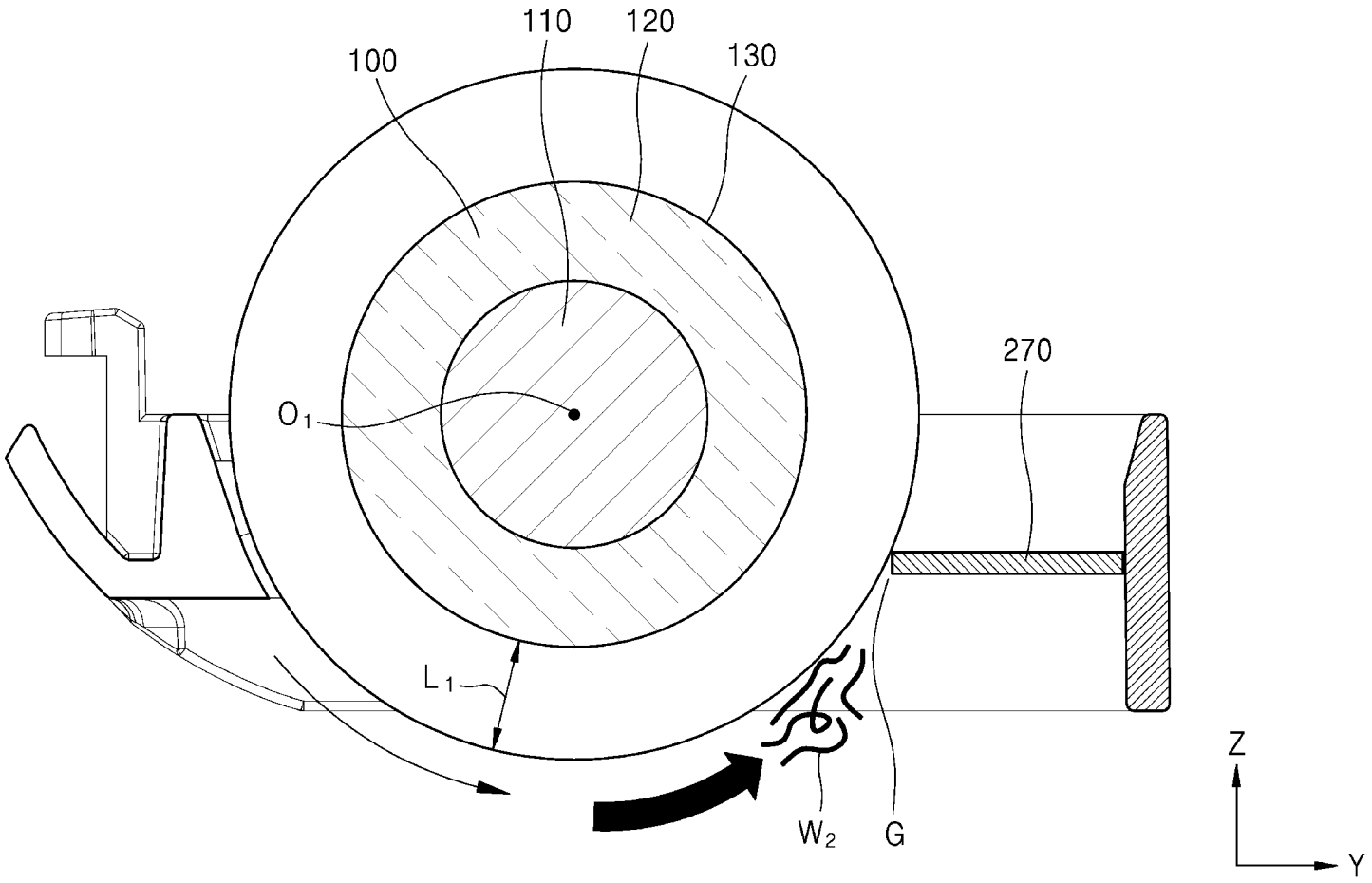
FIG. 8A is a cross-sectional view of a suction unit that sucks in contaminants, according to comparative example 1.
Figure 8B:
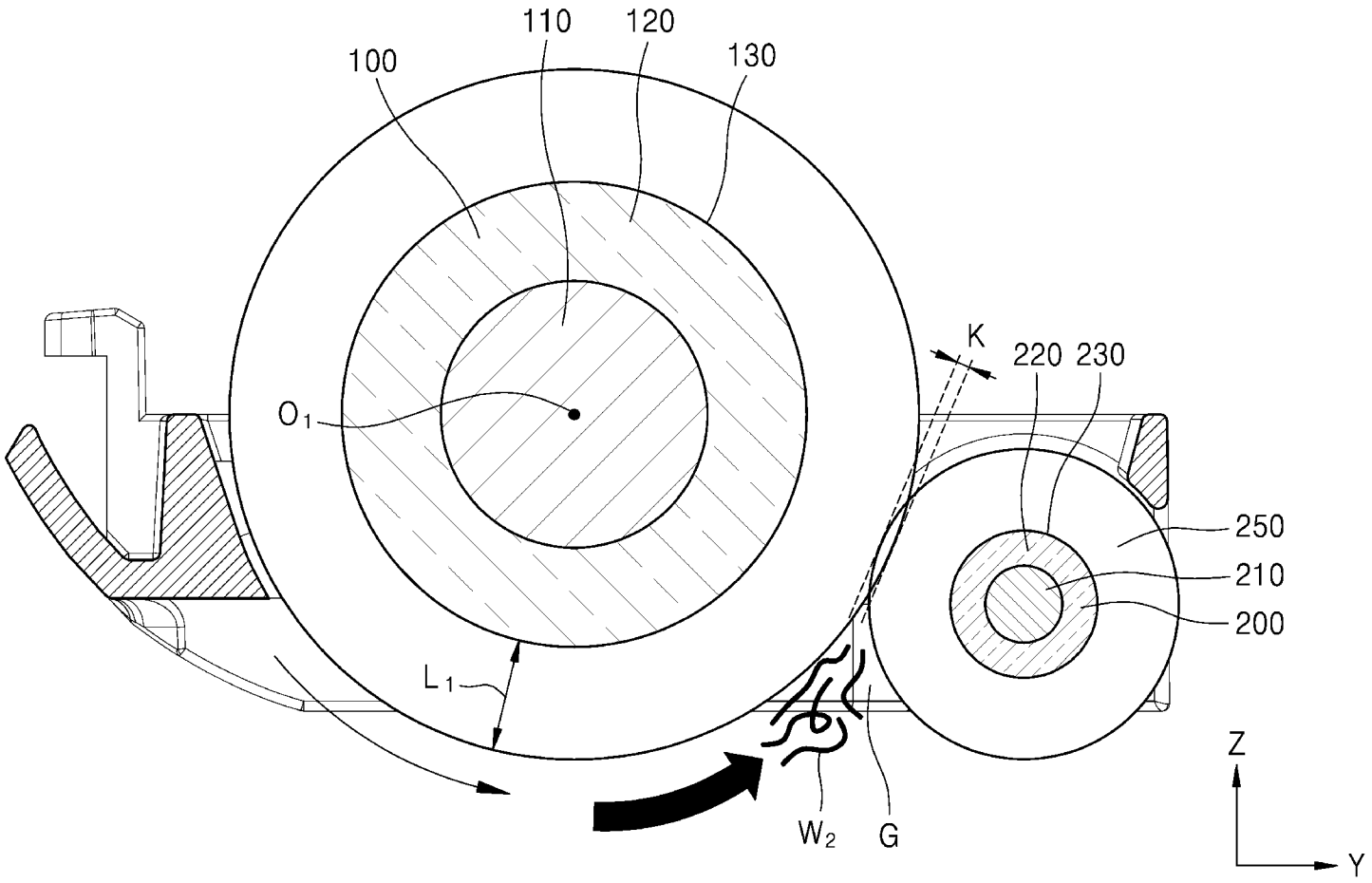
FIG. 8B is a cross-sectional view of a suction unit that sucks in contaminants, according to comparative example 2.

FIG. 8A is a cross-sectional view of a suction unit that sucks in contaminants, according to comparative example 1. FIG. 8B is a cross-sectional view of a suction unit that sucks in contaminants, according to comparative example 2.

Embodiment of the Disclosure

Referring to FIG. 7B, according to an embodiment of the disclosure, the radius $R_1$ of the first circular shape 120 of the first roller 100 is 12 mm. In this case, the length $L_1$ of the first brush 150 extending in the radial direction of the first roller 100 is 5.8 mm. The radius $R_2$ of the second circular shape 220 of the second roller 200 is 3.8 mm. At this time, the length $L_2$ of the second brush 250 extending in the radial direction of the second roller 200 is 4.2 mm. The first distance D between the first roller 100 and the second roller 200 is 9.3 mm. The first range K in which the first brush 150 and the second brush 250 overlap is 1 mm. The first roller 100 may rotate counter-clockwise at a rotation speed of 500 rpm to 1500 rpm. The second roller 200 may rotate counter-clockwise at a rotation speed of 15 rpm to 20 rpm.

Comparative Example 1

Referring to FIG. 8A, except for a configuration in which a blocking wall 270 is provided so as to contact one end of the first brush 150, the rest of the configuration in comparative example 1 is the same as that in the embodiment of the disclosure. A distance between the first roller 100 and the blocking wall 270 is equal to the length $L_1$ of the first brush 150.

Comparative Example 2

Referring to FIG. 8B, except for a configuration in which the second roller 200 does not rotate, the other configuration in comparative example 2 is the same as that in the embodiment of the disclosure.

In the embodiment of the disclosure, the degree of vacuum according to the suction pressure at the suction port G may be 15 m/s to 20 m/s. In the comparative example 1, the degree of vacuum according to the suction pressure at the suction port G may be 3 m/s to 5 m/s. By comparing the degree of vacuum in the embodiment of the disclosure with that in the comparative example 1, it can be seen that the suction pressure may be increased by substantially reducing the area of the suction port G where the suction pressure is generated within the first range K where the first brush 150 and the second brush 250 overlap. In addition, in the comparative Example 1, because the distance between the first roller 100 and the blocking wall 270 may be limited to the length $L_1$ of the first brush 150, the area of the suction port G may be limited. Accordingly, the contaminant W1 shown in FIG. 7A is not able to pass through the suction port G due to its relatively large size.

In comparative example 2, the degree of vacuum according to the suction pressure at the suction port G may be 3 m/s to 5 m/s. By comparing the degree of vacuum in the embodiment of the disclosure with that in the comparative example 2, it can be seen that the suction pressure at the suction port G may be increased as the second brush 250 rotates in the same direction as the first brush 150.

Figure 9A:
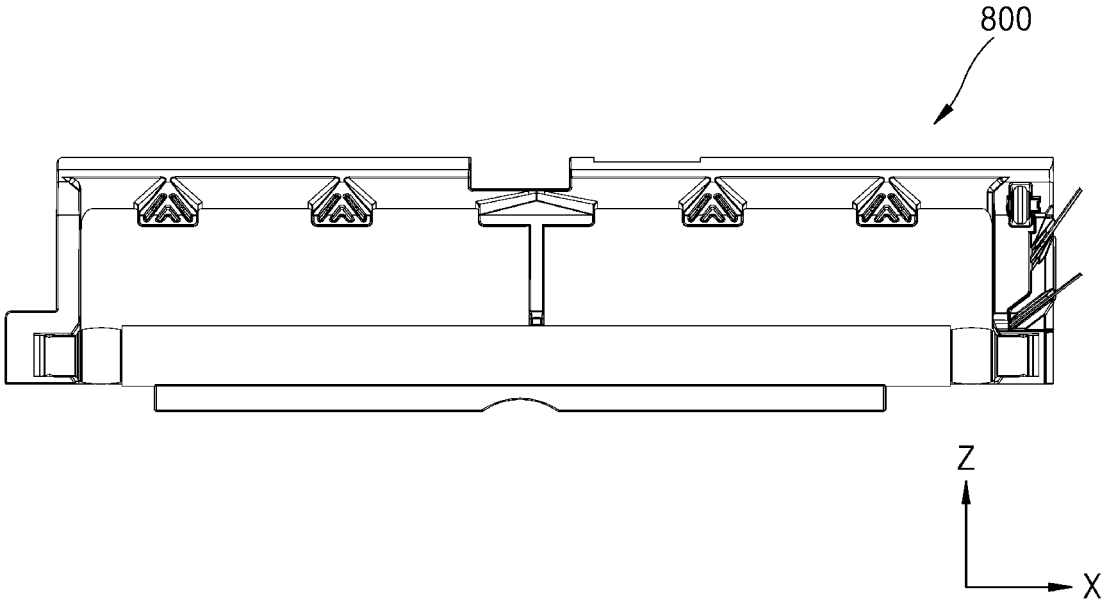
FIG. 9A is a perspective view of a support frame module detachable from a main body, according to an embodiment of the disclosure.
Figure 9B:
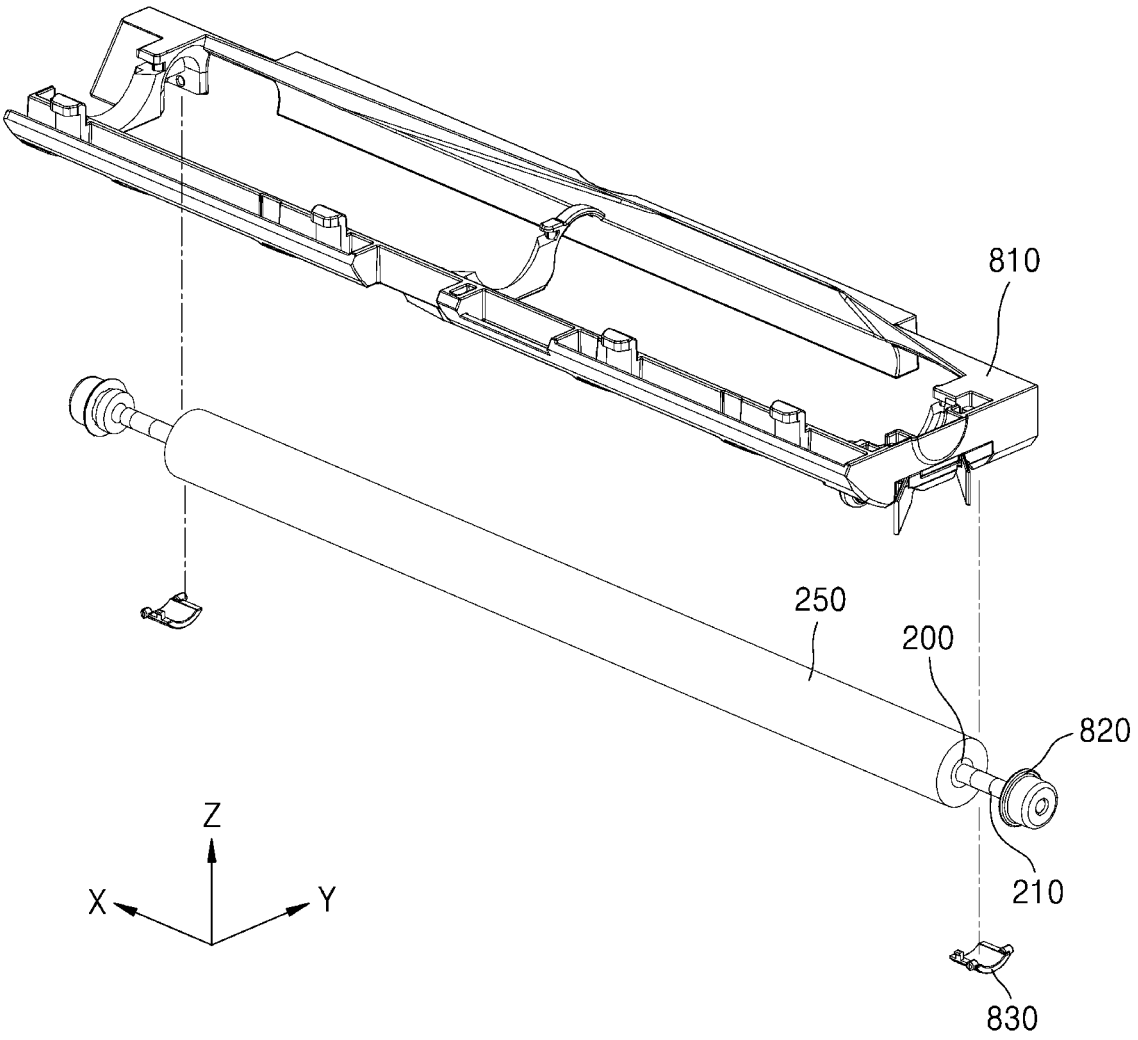
FIG. 9B is an exploded perspective view of a support frame module according to an embodiment of the disclosure.

FIG. 9A is a perspective view of a support frame module detachable from a main body, according to an embodiment of the disclosure. FIG. 9B is an exploded perspective view of a support frame module according to an embodiment of the disclosure.

Referring to FIGS. 3, 5A, 9A and 9B, a support frame module 800 according to an embodiment of the disclosure may be provided to be detachable from the main body 10. For example, the support frame module 800 may further include a support frame 810, a bearing 820, and a coupling member 830 in addition to the second roller 200 and the second brush 250.

The support frame 810 may be provided to be detachable from a bottom of a front of the main body 10. According to an embodiment of the disclosure, when the main body 10 is moved by the traveling unit 20, the support frame 810 may be moved with the main body 10 while a bottom of the support frame 810 comes into contact with the surface to be cleaned or is separated therefrom by a certain distance.

According to an embodiment of the disclosure, the support frame 810 may include an accommodation space therein. For example, the support frame 810 may be coupled to the main body 10 to move with the main body 10, and have any shape capable of accommodating the second roller 200 therein. For example, the support frame 810 may have a hollow polygonal column shape elongated in a transverse direction.

According to an embodiment of the disclosure, the second roller 200 may be detachably connected to the accommodation space of the support frame 810. For example, the second roller 200 may be connected to be rotatable relative to the support frame 810 around the second axis 210 in the first rotation direction. For example, both ends of the second roller 200 may be detachably coupled to sides of the support frame 810. In this case, the bearings 820 may be provided at either end of the second axis 210 that is a central axis of the second roller 200 to support the second axis 210.

According to an embodiment of the disclosure, when the second roller 200 is connected to the support frame 810, the coupling member 830 may be fastened to the support frame 810 so that the second roller 200 is fixed to the support frame 810. For example, the coupling member 830 may be provided in the form of cap covers provided at either end of the second roller 200 and fastened to the support frame 810.

Figure 10:
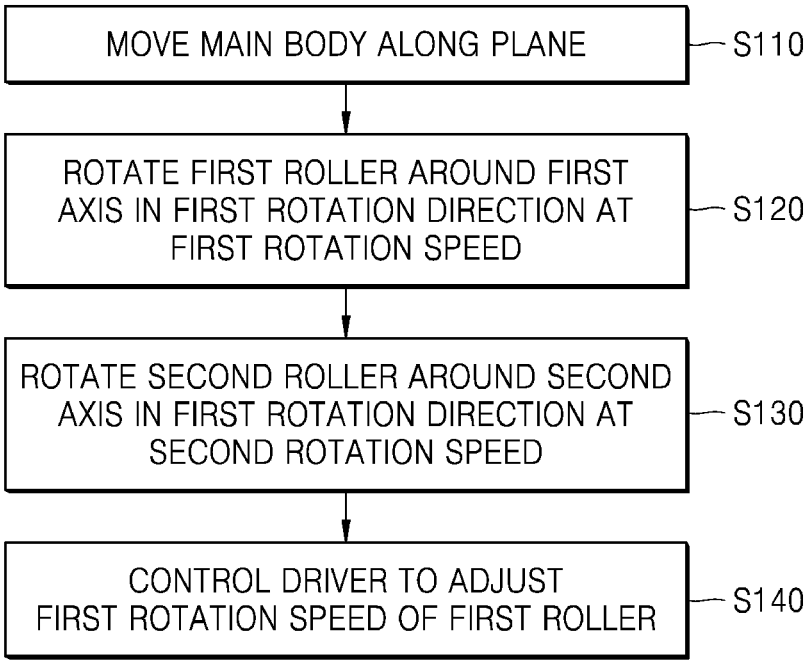
FIG. 10 is a flowchart of an operation method of a cleaning device, according to an embodiment of the disclosure.
Figure 11:
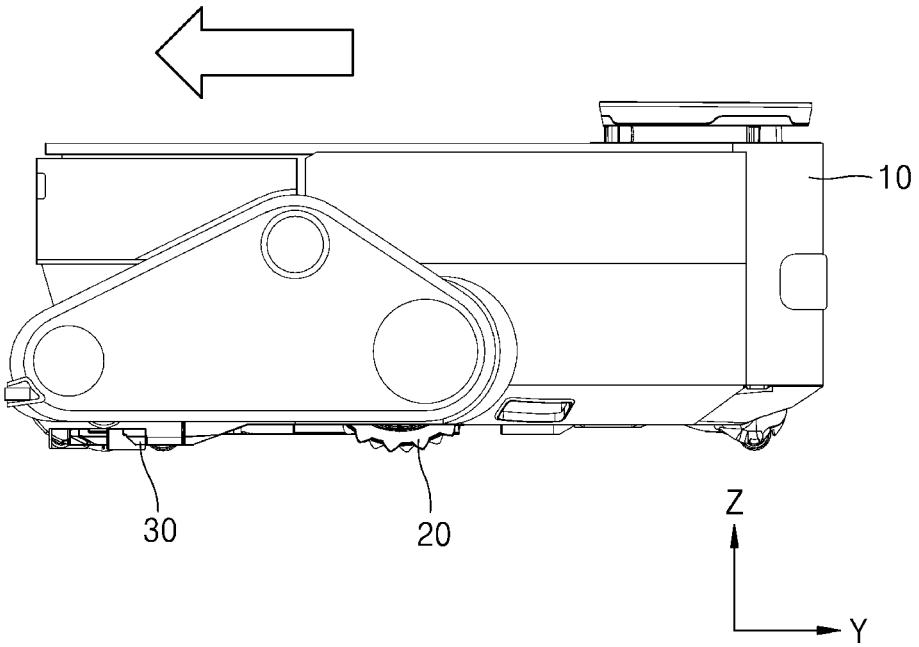
FIG. 11 is a side view of a traveling cleaning device according to an embodiment of the disclosure.
Figure 12:
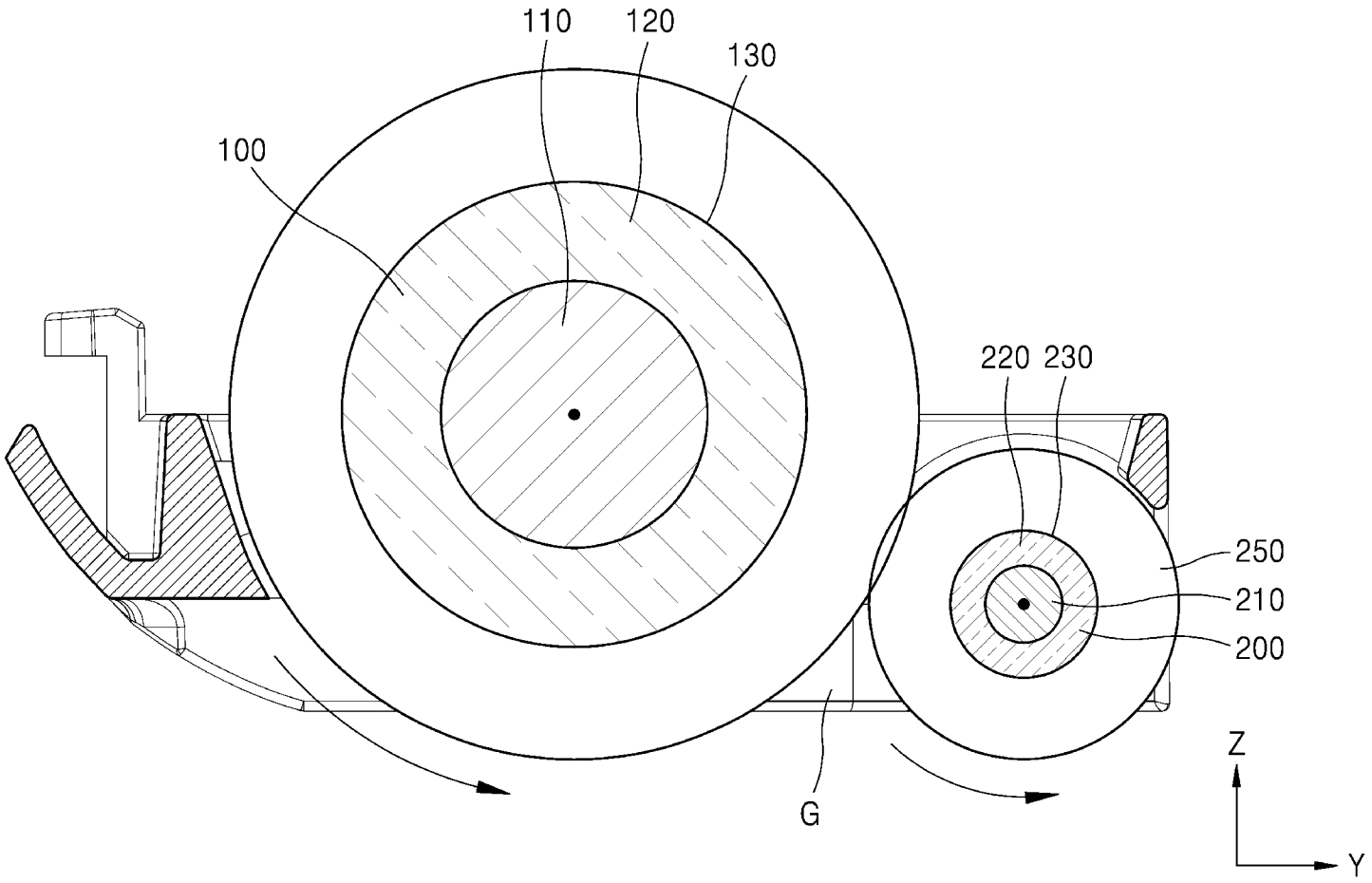
FIG. 12 is a cross-sectional view of a suction unit according to an embodiment of the disclosure.

FIG. 10 is a flowchart of an operation method of a cleaning device, according to an embodiment of the disclosure. FIG. 11 is a side view of a cleaning device traveling according to an embodiment of the disclosure. FIG. 12 is a cross-sectional view of a suction unit according to an embodiment of the disclosure.

Referring to FIG. 10, in the operation method of the cleaning device according to an embodiment of the disclosure, the main body 10 may move along a plane (an XY plane). (S110). For example, the main body 10 may move in a first direction (X direction) or a second direction (a Y direction) by using the traveling unit 20. For example, as shown in FIG. 11, the main body 10 may move forward in the second direction (Y direction) by using the traveling unit 20.

Next, the first roller 100 may rotate around the first axis 110 in a first rotation direction at a first rotation speed (S120). For example, as shown in FIG. 12, the first roller 100 may rotate around the first axis 110 in the first rotation direction. In this case, a driving force generated by the driver 300 is transmitted to the first roller 100 so that the first roller 100 is able to rotate at the first rotation speed.

According to an embodiment of the disclosure, when the first roller 100 rotates, the first brush 150 provided on the outer circumferential surface of the first roller 100 may also rotate about the first axis 110. As the first brush 150 rotates, a suction motor (not shown) operates, and accordingly, contaminants adhering to the first brush 150 may be sucked into the suction port G.

Subsequently, the second roller 200 may rotate around the second axis 210 in the first rotation direction at a second rotation speed (S130). For example, as shown in FIG. 12, the second roller 200 may rotate around the second axis 210 in the first rotation direction. According to an embodiment of the disclosure, the second brush 250 may be provided on the outer circumferential surface of the second roller 200. As the main body 10 moves along the plane, the second brush 250 may come into contact with the surface to be cleaned and rotate in the first rotation direction. In this case, a separate driver capable of transmitting power may not be connected to the second roller 200. Accordingly, the second rotation speed of the second roller 200 may be determined according to a speed at which the main body 10 moves.

Next, when a ratio of the second rotation speed of the second roller 200 to the first rotation speed of the first roller 100 exceeds 0.04 or is less than 0.01, the driver 300 is controlled to adjust the first rotation speed (S140). According to an embodiment of the disclosure, the first sensor 500 may detect the first rotation speed of the first roller 100. Also, the second sensor 600 may detect the second rotation speed of the second roller 200. For example, the ratio of the second rotation speed of the second roller 200 to the first rotation speed of the first roller 100 may be greater than or equal to 0.01 but less than or equal to 0.04. According to an embodiment of the disclosure, the controller 700 may respectively receive the first rotation speed of the first roller 100 and the second rotation speed of the second roller 200 from the first sensor 500 and the second sensor 600. When the ratio of the second rotation speed of the second roller 200 to the first rotation speed of the first roller 100 exceeds 0.04 or is less than 0.01, the controller 700 may control an operation of the driver 300 to adjust the first rotation speed of the first roller 100. Accordingly, the ratio of the second rotation speed of the second roller 200 to the first rotation speed of the first roller 100 may be maintained constant.

The above-described embodiments of the disclosure are merely examples, and various modifications and other equivalent embodiments of the disclosure may be made therefrom by one of ordinary skill in the art. Therefore, the true scope of technical protection of the disclosure will be defined by the technical spirit of the disclosure as indicated by the following claims.

The invention claimed is:

1. A cleaning device comprising:

a main body configured to be movable along a plane;

a first roller longitudinally extending in a first direction and arranged to be rotatable relative to the main body;

a first brush arranged on an outer circumferential surface of the first roller;

a driver configured to generate power to rotate the first roller;

a first sensor configured to detect a first rotation speed of the first roller;

a second roller longitudinally extending in the first direction and arranged so as to be spaced apart from the first roller by a first distance and to be rotatable relative to the main body;

a second brush arranged on an outer circumferential surface of the second roller;

a second sensor configured to detect a second rotation speed of the second roller; and a controller configured to respectively receive the first rotation speed and the second rotation speed from the first sensor and the second sensor to control an operation of the driver, wherein the first roller and the second roller are configured so that:

the first roller is rotatable by the driver in a first rotation direction around a longitudinal axis of the first roller, the second roller is rotatable, by movement of the main body along a surface to be cleaned, in the first rotation direction around a longitudinal axis of the second roller, the first brush and the second brush overlap within a first range, and the first distance exceeds the first range, and the controller is configured to control the operation of the driver such that the first rotation speed of the first roller is controlled based on the detected second rotation speed of the second roller.

2. The cleaning device of claim 1, wherein a ratio of the first range to the first distance is greater than or equal to 0.04 but less than or equal to 0.32.

3. The cleaning device of claim 1, wherein the outer circumferential surface of the first roller is of a first circular shape, a radius of the first circular shape is greater than or equal to 6 mm but less than or equal to 18 mm, and a length of the first brush extending in a radial direction of the first roller is greater than or equal to 2.9 mm but less than or equal to 8.7 mm.

4. The cleaning device of claim 3, wherein the outer circumferential surface of the second roller is of a second circular shape, a radius of the second circular shape is greater than or equal to 1.9 mm but less than or equal to 5.7 mm, and a length of the second brush extending in a radial direction of the second roller is greater than or equal to 2.1 mm but less than or equal to 6.3 mm.

5. The cleaning device of claim 4, wherein the first range in which the first brush and the second brush overlap is a range greater than or equal to 0.5 mm but less than or equal to 1.5 mm.

6. The cleaning device of claim 1, wherein the controller is configured to control the to generate power to rotate the first roller so that a ratio of the second rotation speed to the first rotation speed is greater than or equal to 0.01 but less than or equal to 0.04.

7. The cleaning device of claim 1, wherein the controller is configured to control the driver to rotate the first roller to rotate at a speed greater than or equal to 500 revolutions per minute (rpm) but less than or equal to 1500 rpm.

8. The cleaning device of claim 1, further comprising:

a support frame configured to be detachable from the main body, wherein the second roller is configured to be rotatable relative to the support frame.

9. The cleaning device of claim 8, wherein the second roller includes a rod that is configured to be detachable from the support frame, and is coaxial with the longitudinal axis of the second roller.

10. The cleaning device of claim 9, further comprising:

bearings at either end of the rod of the second roller to support the rod of the second roller.

11. The cleaning device of claim 8, further comprising:

a coupling member that is detachably fastened to the support frame so that the second roller is fixed to the support frame.

* * * * *